United States Patent [19]

Koenig

[11] 4,144,075

[45] Mar. 13, 1979

[54] WAX COMPOSITION FOR INVESTMENT CASTING AND CASTING METHOD

[75] Inventor: Myron Koenig, Mamaroneck, N.Y.

[73] Assignee: M. Argueso & Co., Inc., Mamaroneck, N.Y.

[21] Appl. No.: 783,207

[22] Filed: Mar. 31, 1977

Related U.S. Application Data

[63] Continuation-in-part of Ser. No. 653,359, Jan. 29, 1976, abandoned, which is a continuation of Ser. No. 533,633, Dec. 17, 1974, abandoned.

[51] Int. Cl.[2] ..... B28B 7/34

[52] U.S. Cl. ..... 106/38.8; 106/230; 106/272; 260/28.5 R

[58] Field of Search ..... 106/38.8, 38.25, 38.7, 106/38.6, 268, 272, 230; 260/28.5 R

[56] References Cited

U.S. PATENT DOCUMENTS

| | | | |
|---|---|---|---|
| 3,125,453 | 3/1964 | Simonds | 106/10 |
| 3,854,962 | 12/1974 | Speyer | 106/38.7 |

*Primary Examiner*—Lorenzo B. Hayes

*Attorney, Agent, or Firm*—Parmelee, Johnson, Bollinger & Bramblett

[57] ABSTRACT

Investment casting wax compositions having improved properties and characteristics and improved usefulness in investment casting processes comprises base wax compositions having incorporated therein hexamethylenetetramine, HMTA, as a filler in an amount of from about 5 to 60% by weight based on the weight of the final composition.

9 Claims, No Drawings

WAX COMPOSITION FOR INVESTMENT CASTING AND CASTING METHOD

RELATED APPLICATIONS

This application is a continuation-in-part of copending application Ser. No. 653,359, filed Jan. 29, 1976 which is a continuation of Ser. No. 533,633, filed Dec. 17, 1974, both now abandoned.

FIELD OF THE INVENTION

This invention relates to wax compositions for investment casting and to the use of such compositions for investment casting. More particularly, this invention relates to a filler for wax compositions for investment casting.

DESCRIPTION OF THE PRIOR ART

Since very ancient times, going back at least to the Shang Dynasty in China, the so-called "lost-wax" process has been employed for the manufacture of castings. Essentially, this process comprises forming a pattern of wax or blends of various suitable waxes and resins. This finished pattern is then invested with a suitable medium, such as a ceramic or refractory slurry, which is then solidified and becomes a mold around the wax pattern. The pattern material or more commonly the wax is then removed from the mold by melting it and/or by burning, and a molten metal is poured into the now empty mold to produce the finished part. Further description of investment casting are found in U.S. Pat. Nos. 3,263,286 and 3,667,979, as well as in the *Investment Casting Handbook* of the Investment Casting Institute, 1968.

Such a process has many obvious advantages for making parts, especially intricate parts, which cannot be made, for example, by machining. However, the properties of the casting waxes are extremely important for the production of such parts in modern day usage of this process.

A summary of some of the requisite physical properties of such pattern materials is found in the British publication entitled "*PATTERN MATERIALS AND THEIR USE IN INVESTMENT CASTING*" *of the Pattern-Making Committee of the B. I. C. T. A.*

One of the major drawbacks in the use of investment casting wax compositions is that conventionally the wax must be injected at temperatures somewhat above room temperature, i.e., 105° F. to 190° F. Waxes are non-Newtonian fluids so that when injected under pressure, they are subjected to shearing forces causing them to become somewhat more fluid. It is not necessary to heat waxes until they are completely liquid in order to completely fill the interstices of a die; nevertheless, they must be heated to some extent. Thus, when injected into a complicated die, thin wax sections cool relatively quickly, reproducing that particular section with a high degree of dimensional accuracy, but the wax in heavier sections will shrink considerably more. Additionally, because of these different rates of cooling and shrinkage, considerable strain can be imposed on the wax pattern, and when removed from the die, the pattern may readily distort in order to relieve the strain.

To a limited extent, such dimensional problems can be compensated for by retooling of the master die. Such retooling is a complicated procedure at best, and in addition, such a tailoring of a die is costly and is not completely reliable. Moreover, heating up of the die with repeated injections, large ambient temperature variations and the like, all further combine to produce a considerable loss of precision in the mass reproduction of pattern dimensions.

This problem in investment casting caused by distortion of the patterns due to shrinkage has long troubled the art. Solution of this problem has been attempted by inclusion of various filler materials in the investment casting wax composition. While this feature has met with some degree of success, it has also introduced some new problems as well as leaving other problems unsolved.

For one thing, the wax composition must be safe to handle as a solid and must be capable of convenient melting or burning out of a mold. It is also essential that the wax composition have a low ash content; that is, about 0.03% or less. It is also necessary that such wax compositions be of sufficient strength and be hard enough at room temperature, so that the patterns be self-supporting and can be handled without damage.

Among the various materials that have been suggested as useful fillers for such investment casting wax compositions but which have not met all the desirable physical properties for pattern making or have resulted in new problems there may be mentioned the following filler materials:

1. Carbon black has been used on occasion but because of its fine particle size it has been extremely difficult to handle.

2. Polystyrene beads can be used as suggested by U.S. Pat. No. 3,465,808; however, during autoclave removal of the wax, the wax melts out first leaving a polystyrene residue that tends to tear the ceramic mold wall.

3. It is suggested in U.S. Pat. No. 3,316,705 that various dicarboxamides be employed as fillers. However, such fillers partially dissolve in the base wax diminishing its desired function of decreasing shrinkage, and the wax composition becomes inconsistent in properties and composition. Additionally, because of their high melting points and viscosities, only small batches of the wax compositions can be prepared at a time.

4. Another group of suggested filler materials are phthalic acid compounds suggested in U.S. Pat. No. 3,655,414. Such acidic fillers affect ceramic molds, and they tend to gum up the molten wax at high temperatures.

5. Imides of polycarboxylic acids are disclosed in U.S. Pat. No. 3,717,485. The major drawback to their present use is the current higher costs of these imides.

6. More recently, pentaerythritol and related compounds have been suggested as suitable filler materials, such as, for example U.S. Pat. Nos. 3,801,355; 3,854,962 and 3,884,708. However, when the autoclave method is used to dewax a mold, these fillers tend to cake on the mold wall and then coke up in the burn-out oven. An extremely long period of time for burn out is then required to oxidize the coke.

7. Decachlorinated biphenyl has been used in past years as a filler material; however, it is a PCB compound, and as such has been banned from all use by the Environmental Protection Agency.

It has been a recent problem in the use of most of the above fillers in waxes, that during autoclave dewaxing of ceramic shells, there is an excessive breakage of these ceramic shells, such that they become unsuitable for use as molds for receiving molten metal. This recent occurrence of excessive shell mold breakage is not yet fully understood by the industry.

It is apparent that a need still remains for an acceptable filler wax composition which has all the desirable physical properties for investment casting and does not possess the disadvantages of the other types of fillers presently in use.

An object of the present invention is to overcome the difficulties of the wax composition as presently in use and as described hereinbefore.

Another object of this invention is to provide an investment casting wax which due to the inert filler present hardens considerably faster than non-filled investment casting wax and subsequently becomes stronger due to its filler content.

Additionally, another further object of this invention is to provide an investment casting wax that overcomes the dimensional problem of excessive shrinkage by the use of a filler material that has a desirable melting point, is not soluble in molten wax, is of essentially harmless flammability or combustibility, economical, of low toxicity, and low ash content.

A still further object of this invention is to provide such an investment casting composition than can be used with any of the known dewaxing processes without resulting in any of the problems that have developed with the use of previously used filler materials.

SUMMARY OF THE INVENTION

These and other objects of the invention are accomplished by employing hexamethylenetetramine, also known as HMTA and methenamine, as a filler for investment casting compositions. The HMTA is employed in an amount of from about 5 to about 60% by weight, more generally from about 15 to 55% by weight, and most preferably in an amount of from about 20 to 45% by weight based on the total weight of the final wax composition.

The HMTA employed in the composition of this invention is of a particle size such that generally about 95% by weight will pass through a 100 mesh screen and at least 90% by weight will be retained on a 170 mesh screen. (U.S. Standard Sieve series.)

DETAILED DESCRIPTION OF THE INVENTION

HMTA has a relatively low specific gravity of 1.27 gm/cc compared to previously used fillers and, therefore, stays in suspension better, resulting in a more uniform product which does not clog the injection machine pumps. Heretofore, in attempting to overcome this problem, the fillers were ground finer. However, this resulted in a greatly increased surface area, so that the filler content had to be reduced to achieve an equivalent fluidity and workability. Among the advantages of HMTA is that it is less likely to settle out of suspension when the wax is molten. Also, due to its comparative low specific gravity when compared to most other filler materials, a wax filled with HMTA will yield more patterns per pound than the same wax filled with the same weight percent of most other fillers.

Another important and unexpected result from the use of HMTA as a filler for investment casting waxes is the fact that although HMTA is water soluble, to the extent of 67 grams per 100 ml water, and whereas previously it was thought that only fillers with little or no water solubility could be employed since some of the patterns come in contact with water during subsequent handling and processing especially in the investment shell process, it was unexpectedly found that HMTA containing investment casting wax compositions can be used quite well in such shell processes.

Because HMTA has a much lower melting point than isophthalic acid and deca chlorinated biphenyl, and starts to sublime before melting, autoclave dewaxing will be much more effective in removing the wax, and unlike pentaerythritols, HMTA does not exhibit the caking that results in steam autoclave removal of that particular pattern wax product.

The flammability of HMTA is particularly advantageous. It not only burns with a smokeless flame but it is a solid fuel and combusts completely. It is not an ecological pollutant as is deca chlorinated biphenyl, which remains substantially unchanged at high temperatures. Since HMTA is readily flammable, it is considerably easier to burn out both in the flash dewaxing process as well as in the autoclave firing process than any of the known fillers which leave residues, tear the mold surfaces, cake, or char. The use of this filler overcomes the traditional problems of wax-resin blends, which by their very nature harden slowly and once hardened, tend to lack the needed strength in the necessary subsequent handling.

HMTA filled investment casting wax compositions enjoy low shrinkage characteristics with the result that the dimensions of the refractory molds more closely correspond to those of the final metal castings.

An additional advantage of the use of HMTA is the lack of solubility, even over a week's period, in the other components of the wax composition and thus does not result in a change of the other components.

Also with the use of HMTA as a filler there is no agglomeration of the filler at the normal temperatures of use. Similarly, such HMTA containing compositions do not present any significant problems with slurries or adversely affect the pH of the slurries.

In accordance with this invention, HMTA in an amount of from about 5 to about 60% by weight is incorporated into a base wax composition suitable for use in investment casting and particularly for use as a pattern wax.

The wax composition of the present invention thus contains HMTA in any suitable base wax composition. The wax generally constitutes from about 40 to 95% by weight, more generally from about 45 to 85%, and most preferably from about 55 to 80% by weight of the final composition.

Suitable base wax compositions can include petroleum waxes, natural vegetable or mineral waxes, synthetic waxes and various resinous materials derived from the refining of petroleum and wood resins, terpene-type resins or mixtures of these materials or any of those waxes disclosed in the prior art patents mentioned previously. The base wax compositions can thus contain one or more hydrocarbon materials or other organic materials having for instance, oxygen-containing groups, as in the case of stearic acid or abietic acid, or nitrogen-containing groups such as in the case of amides. The base wax compositions usually melt at temperatures in the range of about 120° to about 180° F.

A suitable base wax consists essentially of 0 to 15% vegetable wax, 20 to 60% of petroleum wax consisting of mixtures of paraffin waxes having a melting point of from 120° to 160° F. and microcyrstalline waxes having a melting point of from 135° F. to 195° F., 1 to 12% of synthetic waxes such as Fisher-Tropsch waxes, polyethylene, ethylene vinyl acetate, or amides, and about 13 to 70% of various resins, such as chlorinated aromatic hydrocarbon resins, such as Aroclor 5460, or resins derived from the refining of petroleum or of wood products, particularly those known as polyterpene resins, such as Nirez. "Aroclor" is the trademark of Monsanto for its brand of polychlorinated polyphenyls. The preferred vegetable waxes are candellila and carnauba waxes. "Nirez" is now a trademark of Reichhold Chemicals, Inc. (formerly a trademark of Tenneco Chemicals, Inc.) for its brands of polyterpene resins, terpene phenols and zinc resinates. These base waxes are well known in the art and, therefore, they need not be described further.

The final form of the wax composition containing the HMTA filler can be in flake, slab or billet form. Such compositions are of low ash content, generally below about 0.02% by weight. Additionally to be suitable as a wax for investment casting, the wax must be of sufficient hardness to form acceptable patterns with minimal shrinkage. Such HMTA containing investment casting waxes have a hardness based on the ASTM D-5 needle penetration test using the Investment Casting Institute modification of a 450 gm total weight on the needlepoint, of between 5 to 15 and possibly from 2 to 25 or 30 tenths of millimeters (dmm). This Investment Casting Institute needle penetrometer testing procedure is described in the publication dated Nov. 1971, entitled: *Standard Material Specification for Pattern Materials* by the Investment Casting Institute, in the section entitled: "Determination of Consistency-Needle Penetration Method".

The following specific examples are illustrative of the improved investment casting wax compositions of the present invention and their use. Exemplary investment casting wax compositions of this invention are described in Examples I to III.

EXAMPLE I

| | | |
|---|---|---|
| 6.2 | weight percent | Carnauba wax |
| 29.9 | " | Chlorinated Polyphenyl Resin, 100° C. softening point (Aroclor 5460) |
| 6.8 | " | Microcrystalline Wax 178° F. (ASTM/D127) |
| 3.9 | " | Microcrystalline Wax 171° F. |
| 9.6 | " | Paraffin Wax 145° F. (AMP) |
| .8 | " | Polyethylene 222° F. (ASTM/E28) |
| 42.8 | " | HMTA |

Aroclor 5460 is a chlorinated polyphenyl compound, a product of Monsanto Chemical Co. which contains 59.0–60.6% of chlorine, has a specific gravity of 1.670 (25°/25° C.) and a distillation range of 280°–335° C. at 5 millimeter of mercury.

EXAMPLE II

| | | |
|---|---|---|
| 40 | weight percent | Polyterpene resin 135° C. (ASTM/E28) (Nirez 1135) |
| 21.6 | " | Paraffin 156° F. (AMP) |
| 14.4 | " | Microcrystalline Wax 178° F. (ASTM/D127) |
| 4.0 | " | Polyethylene 244–262° F. (ASTM/D566) |
| 20 | " | HMTA |

Nirez 1135, a polyterpene resin product of the Newport Division of Tenneco Chemicals, Inc., has a specific gravity of 0.995 (25°/25° C.) and a ball and ring softening point of about 135° C.

EXAMPLE III

| | | |
|---|---|---|
| 35 | weight percent | Polyterpene resin 115° C. (ASTM/E28) (Nirez 1115) |
| 19 | " | Paraffin Wax 145° F. (AMP) |
| 12.5 | " | Microcrystalline Wax 178° F. (ASTM/D127) |
| 3.5 | " | Polyethylene 130° C. (ASTM/E28) |
| 30 | " | HMTA |

Nirez 1115, a polyterpene resin product, has a specific gravity of 0.995 (25°/25° C.) and a ball and ring softening point of about 115° C.

Completely acceptable patterns are made with the aforementioned wax compositions containing HMTA as a filler according to known investment casting techniques.

In another aspect of this invention, a method of investment casting is provided wherein the HMTA containing wax compositions are utilized. In such a process a low shrinkage, dimensionally stable, fast setting casting wax having HMTA as a filler, such as those described in Examples I and III, is injected into a suitable die for making a wax pattern. The hardened wax pattern is removed from the die. The pattern (or a cluster of such patterns) is (are) gated to a wax sprue. Then, the sprued pattern or patterns are utilized in either the solid mold investment casting process or the investment shell casting process.

In the solid mold investment casting process, the sprued pattern(s) is invested in a mold slurry which is allowed to harden.

In the investment shell casting process, the sprued pattern(s) is dipped in a slurry of finely divided ceramic material, and a refractory grain is then sifted onto the coating. After suitable drying time, this process of dipping and sifting is repeated several times to build up a desired shell thickness.

In either of the above processes, the HMTA containing wax composition is removed from the ceramic mold by melting in an oven, over a steam bath, or in an autoclave. The ceramic mold is then fired at high temperature to remove the last traces of the wax composition and to cure the ceramic mold itself. Molten metal is then poured into the ceramic mold and allowed to harden. The mold material is then broken away from the castings, the castings removed from the resultant metal sprue, and suitably finished. A more detailed description of these investment casting processes can be found in the *Investment Casting Handbook* referred to above.

It will be appreciated that, as previously stated, HMTA is not soluble in the other components and in fact cannot be and still provide an acceptable investment casting wax. The presence of solvents in investment casting wax compositions results in excessive shrinkage and unacceptable variation in properties of the wax composition.

While it has previously been disclosed to add HMTA to wax polish compositions as an antislip agent to decrease the slipperiness of the film resulting from the deposition of the wax polish on a surface, such antislip property is undesirable for investment casting waxes. Moreover, such wax polish compositions contain solvents for the wax and thus are completely unsuitable as investment casting waxes and additionally such wax polishes are unacceptably soft and subject to excessive shrinkage as the solvent evaporates and are thus completely unacceptable as investment casting waxes.

It should be evident that considerable modification can be made to the exemplary base formations mentioned hereinbefore without departing from the spirit and scope of the present invention.

I claim:

1. An investment casting wax composition for use in the investment casting wax process which consists essentially of a base wax melting in the range of 120° to 180° F. and about 5 to 60% by weight of the final composition of hexamethylenetetramine as a filler, said wax composition having sufficient hardness to form acceptable patterns, and said wax composition being dimensionally stable and having a hardness measurement based on the ASTM D-5 needle penetration test using the Investment Casting Institute modification of a 450 gram total weight on the needlepoint, of from 2 to 30 tenths of millimeters.

2. A composition of claim 1, wherein the hexamethylene-tetramine is of a particle size such that 95% by weight passes through a 100 mesh screen and at least 90% by weight is retained on a 170 mesh screen.

3. A composition of claim 2, wherein the base wax comprises about 0 to 15% vegetable wax, about 20 to 60% petroleum wax consisting of a mixture of paraffins having a melting point of from 120°-160° F. and microcrystalline waxes having a melting point of from about 135° to 195° F., about 1 to 12% synthetic waxes and about 13 to 79% of resins selected from chlorinated aromatic hydrocarbon resins and resins derived from the refining of petroleum or of wood products.

4. A composition of claim 3, wherein the vegetable wax is carnauba wax.

5. A composition of claim 3, wherein the vegetable wax is candellila wax.

6. An investment casting wax composition for use in the investment casting wax process which consists essentially of a base wax melting in the range of 120° to 180° F. and about 5 to 60% by weight of the final composition of hexamethylenetetramine as a filler, said hexamethylenetetramine being of a particle size such that 95% by weight passes through a 100 mesh screen (U.S. Standard Sieve Series) and at least 90% by weight is retained on a 170 mesh screen, said wax composition being of low ash content, generally below about 0.02% by weight, and said wax composition being dimensionally stable and having sufficient hardness to form acceptable patterns, said hardness, based on the ASTM D-5 needle penetration test using the Investment Casting Institute modification of a 450 gram total weight on the needlepoint, having a measurement of from 2 to 30 tenths of millimeters.

7. A low shrinkage, dimensionally stable investment casting wax composition having sufficient hardness to form acceptable patterns for use in the investment casting wax process which consists essentially of a base wax melting in the range of 120° to 180° F. and hexamethylenetetramine as a filler, and being of the following composition: 6.2 weight percent of Carnauba wax; 29.9 weight percent of chlorinated polyphenyl resin having a 100° C. softening point, said resin containing 59.0-60.6% of chlorine and having a specific gravity of 1.670 (25°/25° C.) and a distillation range of 280°-335° C. at 5 millimeters of mercury, 6.8 weight percent of microcrystalline wax having a softening point at about 178° F., 3.9 weight percent of microcrystalline wax having a softening point at about 171° F., 9.6 weight percent of paraffin wax having a softening point at about 145° F., 0.8 weight percent of polyethylene having a ball and ring softening point at about 222° F., and 42.8 weight percent of said hexamethylenetetramine filler, said hexamethylenetetramine filler having a particle size such that 95% by weight passes through a 100 mesh screen of the U.S. Standard Sieve series and at least 90% by weight is retained on a 170 mesh screen.

8. An investment casting wax composition of claim 1 of the following composition: 40 weight percent of polyterpene resin having a specific gravity of 0.995 (25°/25° C.) and a ball and ring sofening point of about 135° C.; 21.6 weight percent of paraffin wax having a softening point at about 156° F.; 14.4 weight percent of microcrystalline wax having a softening point at about 178° F.; 4.0 weight percent of polyethylene softening in the range of 244°-262° F. and 20 weight percent of said hexamethylenetetramine filler.

9. An investment casting wax composition of claim 1 of the following composition: 35 weight percent of polyterpene resin having a specific gravity of 9.995 (25°/25° C.) and a ball and ring softening point of about 115° C.; 19 weight percent of paraffin wax having a softening point of about 145° F.; 12.5 weight percent of microcrystalline wax having a softening point of about 178° F.; 3.5 weight percent of polyethylene having a ball and ring softening point of about 130° C.; and 30 weight percent of said hexamethylenetetramine filler.

* * * * *